US009307833B2

(12) United States Patent
Rosen

(10) Patent No.: US 9,307,833 B2
(45) Date of Patent: Apr. 12, 2016

(54) SHELVING SYSTEM

(71) Applicant: Frederick K. Rosen, Wheaton, IL (US)

(72) Inventor: Frederick K. Rosen, Wheaton, IL (US)

(73) Assignee: Panacea Products Corp., Columbus, OH (US)

( * ) Notice: Subject to any disclaimer, the term of this patent is extended or adjusted under 35 U.S.C. 154(b) by 0 days.

(21) Appl. No.: 14/483,423

(22) Filed: Sep. 11, 2014

(65) Prior Publication Data

US 2015/0069000 A1 Mar. 12, 2015

Related U.S. Application Data

(60) Provisional application No. 61/876,516, filed on Sep. 11, 2013.

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47F 5/00*** | (2006.01) |
| ***A47B 57/14*** | (2006.01) |
| ***A47F 5/13*** | (2006.01) |
| ***A47B 57/38*** | (2006.01) |
| ***A47F 5/01*** | (2006.01) |

(52) U.S. Cl.

CPC ..... *A47B 47/0083* (2013.01); *A47B 47/0058* (2013.01); *A47B 57/14* (2013.01); *A47B 57/38* (2013.01); *A47F 5/01* (2013.01); *A47F 5/13* (2013.01)

(58) Field of Classification Search

CPC ..... A47F 5/13; A47F 5/01; A47F 5/0018; A47F 5/0043; A47F 5/10; A47B 47/0058; A47B 47/0083; A47B 55/02; A47B 57/12; A47B 57/14; A47B 57/06; A47B 57/36; A47B 57/38; A47B 47/00; A47B 47/021; A47B 96/02; A47B 96/021; A47B 96/14

USPC ..... 211/186, 190, 187, 103, 207, 191, 192, 211/181.1, 126.8, 126.9, 133.1, 133.2, 211/133.5, 133.6; 108/106, 107, 144.11, 108/147.11, 147.17

See application file for complete search history.

(56) References Cited

U.S. PATENT DOCUMENTS

| | | | | | |
|---|---|---|---|---|---|
| 2,315,595 | A | * | 4/1943 | Chappory | 211/186 |
| 2,680,522 | A | * | 6/1954 | Temple | 108/59 |
| 3,007,708 | A | * | 11/1961 | Ochs | 280/33.998 |
| 3,303,935 | A | | 2/1967 | Briggs | |
| 3,487,951 | A | * | 1/1970 | Beltzung | 211/133.2 |
| 3,536,016 | A | * | 10/1970 | Chesley | 108/181 |
| 3,680,712 | A | | 8/1972 | Jurasek | |

(Continued)

FOREIGN PATENT DOCUMENTS

| | | |
|---|---|---|
| CN | 101337600 | 12/2001 |
| EP | 1424287 | 6/2004 |

*Primary Examiner* — Jennifer E Novosad

(74) *Attorney, Agent, or Firm* — Vedder Price P.C.

(57) ABSTRACT

A shelving system including a first support unit including a plurality of rungs, a second support unit including a plurality of rungs, at least one shelf unit including a securing unit on opposite ends of the shelf unit where the securing unit includes a first support bar having a first end and a second end and a second support bar having a first end and a second end with each end of the first support bar and second support bar engage opposing rungs on the first support unit and second support unit, where the first support bar is substantially parallel to the second support bar.

6 Claims, 4 Drawing Sheets

(56) References Cited

U.S. PATENT DOCUMENTS

| | | | | | |
|---|---|---|---|---|---|
| 3,986,462 | A | | 10/1976 | Heft | |
| 4,004,526 | A | | 1/1977 | King | |
| 4,159,601 | A | | 7/1979 | Ebert et al. | |
| 4,391,378 | A | * | 7/1983 | Secon | 211/187 |
| 4,809,941 | A | | 3/1989 | Sheridan | |
| 5,221,014 | A | * | 6/1993 | Welch et al. | 211/187 |
| 5,251,973 | A | * | 10/1993 | Hazan | 312/257.1 |
| 5,529,192 | A | | 6/1996 | Conen et al. | |
| 5,588,543 | A | | 12/1996 | Finger | |
| 5,601,038 | A | * | 2/1997 | Welch et al. | 108/193 |
| 5,718,441 | A | * | 2/1998 | Kern et al. | 280/79.3 |
| 5,909,936 | A | | 6/1999 | Daniels et al. | |
| 6,132,158 | A | | 10/2000 | Pfeiffer et al. | |
| 6,173,847 | B1 | * | 1/2001 | Zellner et al. | 211/186 |
| 6,220,461 | B1 | | 4/2001 | Dickinson | |
| 6,234,328 | B1 | | 5/2001 | Mason | |
| 6,497,331 | B1 | * | 12/2002 | Morandi | 211/153 |
| 6,659,294 | B1 | * | 12/2003 | Simard | 211/181.1 |
| 6,889,855 | B2 | | 5/2005 | Nagel | |
| 8,267,261 | B2 | * | 9/2012 | Vanderhoek et al. | 211/150 |
| 2003/0085189 | A1 | * | 5/2003 | De La Fuente | 211/181.1 |
| 2003/0102315 | A1 | | 6/2003 | Cheng et al. | |
| 2004/0256341 | A1 | * | 12/2004 | Donnell et al. | 211/187 |
| 2005/0230332 | A1 | | 10/2005 | Taylor et al. | |
| 2005/0230338 | A1 | | 10/2005 | Farinola et al. | |
| 2010/0000952 | A1 | | 1/2010 | McKinney et al. | |
| 2015/0069000 | A1 | * | 3/2015 | Rosen | 211/186 |

* cited by examiner

SHELVING SYSTEM

CROSS REFERENCE TO RELATED APPLICATION

The present non-provisional utility patent application claims priority from and the benefit of U.S. Provisional Patent Application No. 61/876,516, filed Sep. 11, 2013, entitled SHELVING SYSTEM, which is hereby incorporated herein fully by reference.

BACKGROUND OF THE INVENTION

Shelving and storage systems are widely used throughout the world to organize and store various items in both residential and commercial settings. To reduce the size of the shelving system during shipment to the purchaser, many of the shelving systems available require assembly by the purchaser. The assembly process for typical shelving systems involves snapping or securing the shelves to a support base. Due to low tolerances in manufacturing or improper assembly, many shelving systems are unstable, incapable of securely holding many items, or require cross-braces. These products can be difficult and or time consuming to assemble.

Accordingly, a need exists for a shelving system that is simple to assemble and which provides a sturdy construction.

SUMMARY OF THE INVENTION

One embodiment of the present invention includes a shelving system including a first support unit including a plurality of rungs, a second support unit including a plurality of rungs; and at least one shelf unit including a securing unit on opposite ends of the shelf unit where the securing unit includes a first support bar having a first end and a second end and a second support bar having a first end and a second end with each end of the first support bar and second support bar engage opposing rungs on the first support unit and second support unit, where the first support bar is substantially parallel to the second support bar.

In another embodiment, the first end and second end of the first support bar are substantially L shaped, and the first end and second end of the second support bar are substantially L shaped.

In another embodiment, the L shaped portion of the first support bar and the L shaped portion of the second support bar are substantially parallel.

In another embodiment, corresponding L shaped portions of the first end and second end of the first support bar and second support bar engage one rung on the first support unit and one rung on the second support unit.

In another embodiment, each rung on the first support unit and second support unit include a first bar and a second bar separated by a distance.

In another embodiment, respective L shaped portions of the first support bar engages a first bar of a corresponding rung on the first support unit and second support unit.

In another embodiment, respective L shaped portions of the second support bar engages a second bar of a corresponding rung on the first support unit and second support unit.

In another embodiment, the shelf unit includes a mesh unit substantially coplanar with the second support bar in the shelf unit.

In another embodiment, the mesh unit is affixed to the shelf unit by cross units.

In another embodiment, the cross units are affixed to the first support bars and second support bars.

Another embodiment of the present invention includes a shelf unit having at least two sides comprising a pair of first support bars each on opposing sides of the shelf unit, a pair of second support bars each on opposing sides of the shelf unit, a first securing unit on opposing ends of the first support bar, a second securing unit on opposing ends of the second support bar, a mesh unit between the opposing sides of the shelf unit, a plurality of support units extending from the opposing sides of the shelf unit that are affixed to the second support units and first support units.

In another embodiment, the first securing units and second securing include substantially "L" shaped portions.

In another embodiment, the "L" shaped portions of one first securing unit is substantially parallel with a corresponding "L" shaped portion of a corresponding second securing unit.

In another embodiment, the "L" shaped portions of the first securing unit and second securing unit are configured to engage a rung on a support member.

In another embodiment, the rung is comprised of a first bar and a second bar.

In another embodiment, the first securing unit on the first support bar engages the first bar of the rung on the support member.

In another embodiment, the second securing unit on the second support bar engages the second bar of the rung on the support member.

In another embodiment, the "L" shaped portions of corresponding first securing units and second securing units are separated by a distance.

In another embodiment, the distance is sized to accommodate a rung on a support member.

In another embodiment, the length of the shelving unit is approximately 18.75 inches.

DETAILED DESCRIPTION OF THE INVENTION

The present invention involves a shelving system that provides a secure support structure and simplified assembly. Each of the shelves of the shelving system includes a support member that counteracts torsional forces applied to the shelves due to gravity. Further, the system allows different combinations of shelving arrangements to alter the spacing of the shelves based on a user's needs.

Figure 1:
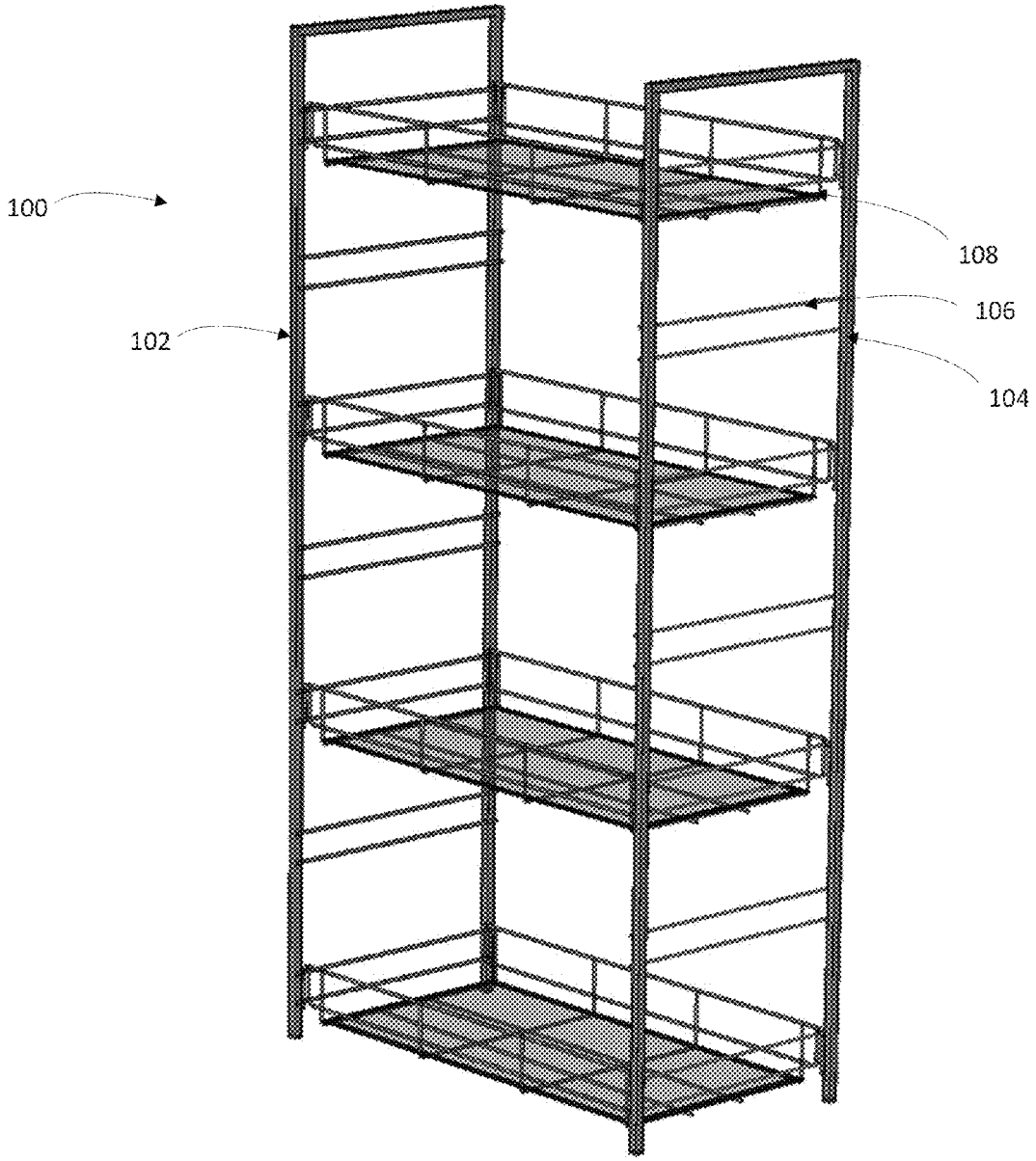
FIG. 1 depicts a perspective view of a shelving system.

FIG. 1 depicts a perspective view of a shelving system 100. The shelving system 100 includes a first support unit 102 and a second support unit 104 with each support unit 102 and 104 including a plurality of rungs 106. Shelving units 108 are each secured to a rung 106 on the first support unit 102 and a corresponding rung 106 on the second support unit 104 by a securing member on each shelving unit 108. Securing units (not shown) on the shelving units 108 engage the rungs of the support units 102 and 104 to create a stable shelving system that provides improved rigidity over existing shelving systems.

Figure 2:
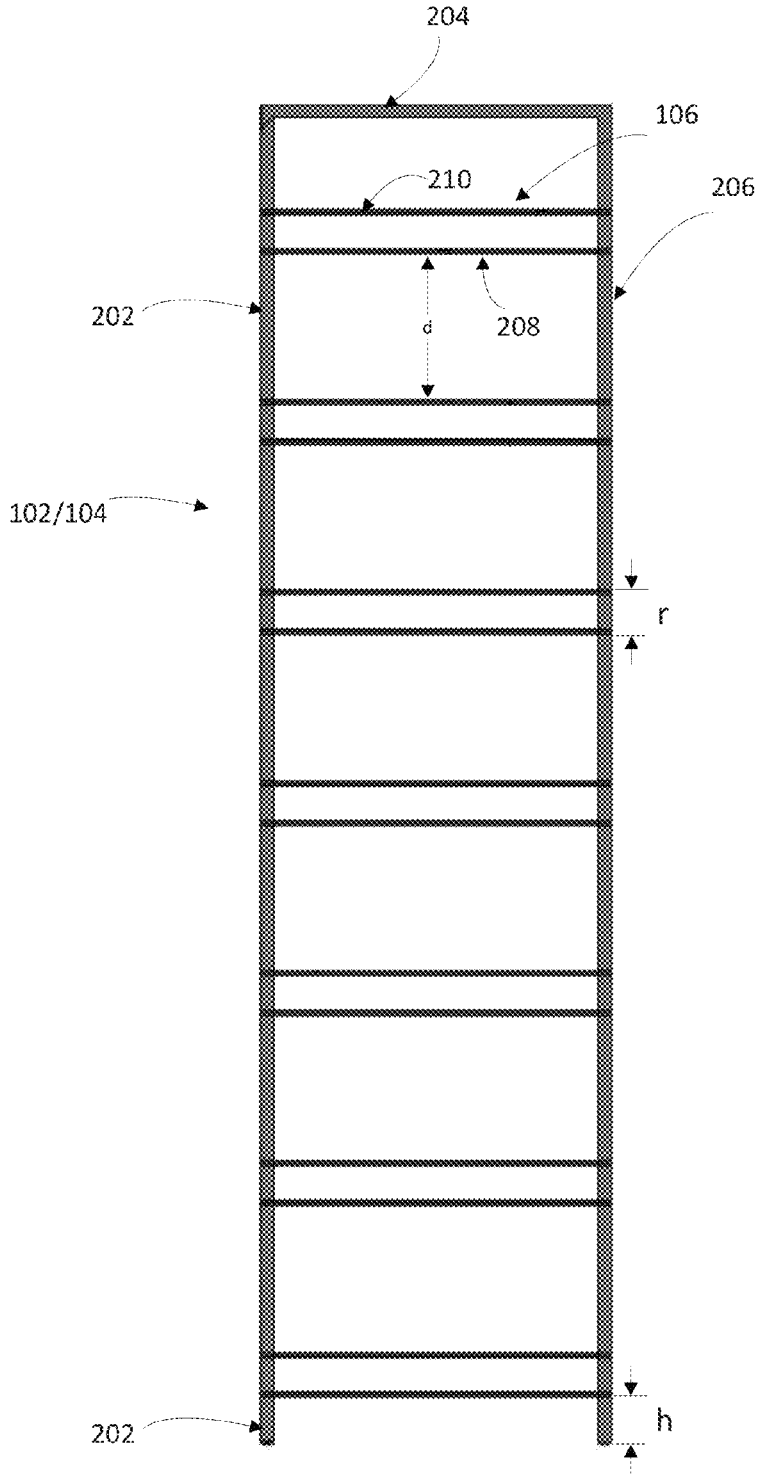
FIG. 2 depicts a side view of the support unit.

FIG. 2 depicts a side view of the support unit 102 or 104. The support units 102 and 104 are substantially U-shaped and include a first support bar 202, an upper support bar 204 and a second support bar 206. Each support unit 102 or 104 is made of a rigid material including, but not limited by, steel, aluminum, copper, plastic, polyvinyl chloride or any other rigid material capable of supporting the shelving units 108. The support bars 102 and 104 may be tubular or solid tubes having a diameter of approximately 10 mm. In one embodiment, end portions of the first support bar 202 and second support bar 206 connect to opposite ends of the upper support bar 204 at substantially perpendicular angles. The end portions may connect using any known method of connecting tubes including the use of couplers, welding, epoxy or any other method of joining the ends of tubes. The end of the support frame 102 or 104 opposite the upper support bar 204 is open.

A plurality of rungs 106 are spaced along the length of the support frames 102 and 104 between the first support bar 202 and second support bar 206. Each rung 106 includes a lower bar 208 and an upper bar 210 that are separated by a distance r. In one embodiment, the distance r is approximately 1.25 inches. In another embodiment, the upper bar 210 and lower bar 208 may be moved relative to one another to adjust the distance r. The lower bar 208 and upper bar 210 may be made of a rigid material including, but not limited by, steel, aluminum, copper, plastic, polyvinyl chloride or any other rigid material capable of supporting the shelving units 108. The lower bar 208 and upper bar 210 may have a circular, square or rectangular cross section having a diameter x. The ends of each upper bar 208 and lower bar 210 are affixed to the first support bar 202 and second support bar 206 by a securing means including, but not limited to, welding, epoxy, metallic glue or any other means of securing the bars 208 and 210 to the support bars 102 and 104. In one embodiment, the lower bar 208 and upper bar 210 of each rung 106 is a circular wire having a gauge of approximately 0.162 inches.

In one embodiment, the support units 102 and 104 are made from a continuous support rod. The rod may have a cross section that is substantially square or rectangular shaped. Consistent with this embodiment, the first support bar 202, upper support bar 204 and second support bar 206 are separated by mitered cuts in opposing sidewalls of the rod. The mitered cuts are formed such that the first support unit 202 and second support unit 206 are substantially perpendicular to the upper bar 204 when the first support unit 202 and second support unit 206 are moved towards one another.

Each of the rungs 106 is separated by a distance d that represents the distance between an upper bar 210 of one rung 106 and a lower bar 208 of an adjacent rung 106. The distance d may be the same distance between each of the rungs 106 or may vary along the length of the support frame 102 or 104. In one embodiment, the distance d is approximately 4.75 inches. The rung 106 closest to the open end of the support frame is separated from the end of the support bars 204 and 206 by a distance h. The distance h represents the distance from the ground to the lower bar 208 of the lowest rung 106 on the shelving system 100. The rungs 106 of the first support unit 102 and second support unit 104 are arranged such that a rung 106 on the first support unit 102 has a corresponding rung at the same elevation on the second support unit 104.

Figure 3:
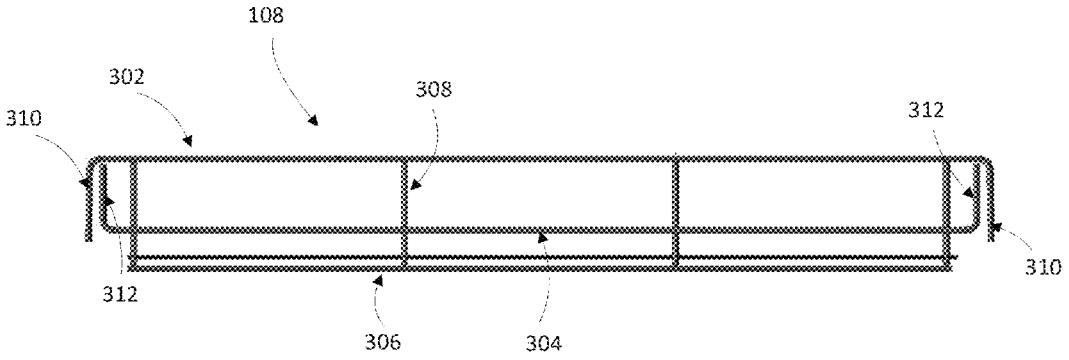
FIG. 3 depicts a side view of a shelving unit.

FIG. 3 depicts a side view of a shelving unit 108. Each shelving unit 108 includes an upper support 302, a lower support 304 and a base 306. The upper support 302, lower support 304 and base 206 each connect to vertical support rods 308. The base 306 may also include side bars that are connected to the vertical support rods 308.

The ends of the upper support 302 are bent to form a substantially L shape portions 310 with the L shaped portions 310 being substantially perpendicular to the lower support 304. The L shaped portions 312 of the lower support 304 are bent such that the L shaped portions 312 of the lower support 304 are substantially parallel with a corresponding L shaped portion 310 of the upper support 302 and perpendicular with the center portion of the upper support 302.

The L shaped portions 310 of the upper support 302 and the L shaped portions 312 of the lower support 304 form the support member. The length of the upper support 302 and lower support 304 are selected such that corresponding L shaped portions 310 and 312 of the supports 302 and 304 are separated by a gap g when supports 302 and 304 are connected to the shelves. The gap g is sized to accommodate the diameter of the lower bar 208 and upper bar 210 of each rung 106. In one embodiment, the L shaped portions 310 and 312 are biased such that opposing L shaped portions 310 and 312 are biased towards each other.

In one embodiment, the length of the shelving unit 108 is approximately 18.875 inches, the depth of the shelving unit is approximately 1.875 inches and the vertical support members 308 are separated by approximately 6.171 inches. In another embodiment, the first support bar 302 is approximately 20.5 inches long and the second support bar is approximately 19.9 inches long. In another embodiment, the L shaped portion 310 of the first support bar 302 taper away from the first support bar 302 and the L shaped portion 312 of the second support bar 304 taper away from the second support bar 304. Consistent with this embodiment, the gap g between the L shaped portion 312 and 310 tapers from the first support bar 302 towards the second support bar 304. The L shaped portions 310 and 312 form an interference fit with the first support bar 302 or second support bar 304. In another embodiment, the L shaped portions 310 and 312 form an interference fit with the first support bar 302 and second support bar 304.

Figure 4:
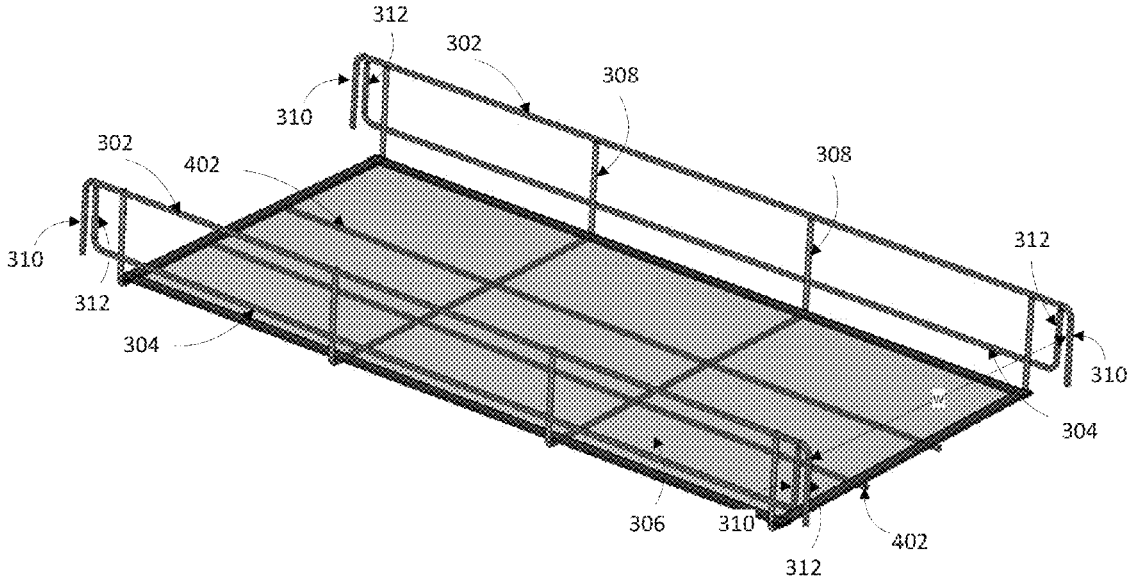
FIG. 4 is a perspective view of the shelving unit.

FIG. 4 is a perspective view of the shelving unit 108. The vertical support units 308 are substantially "U" shaped and include first portions that connect to the upper support bar 302 and lower support bar 304, and a second portion that engages the lower surface of the base 306. The shelving unit 108 may include longitudinal support members 402 positioned between the base 306 and the vertical support member 308. In one embodiment, the width w of the shelving unit 108 is approximately 9.875 inches.

Figure 5:
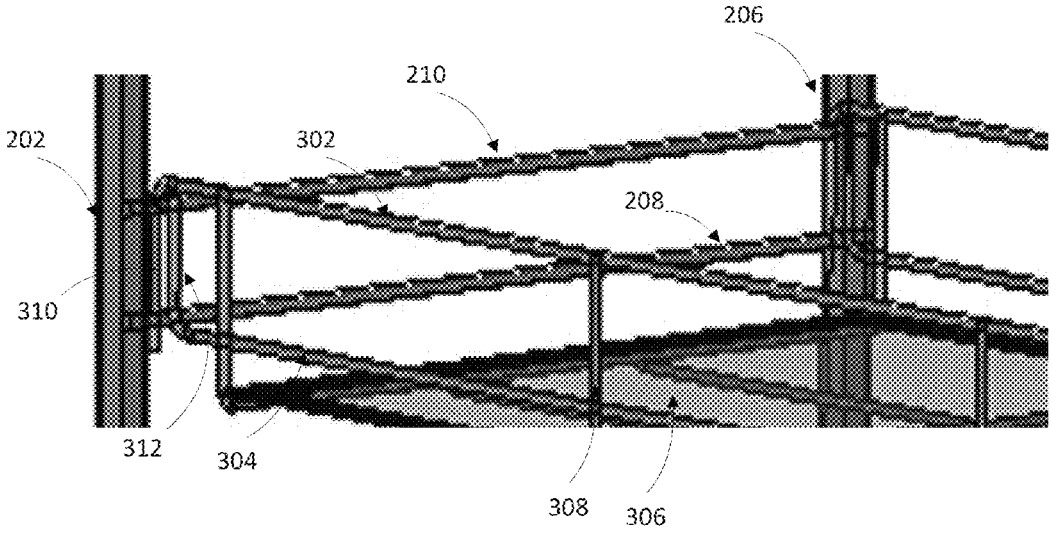
FIG. 5 depicts a perspective view of a shelving unit engaging the upper bar and lower bar of a rung.

FIG. 5 depicts a perspective view of a shelving unit 108 engaging the upper bar 210 and lower bar 208 of a rung 106. The upper support bar 302 of the shelving unit 108 extends beyond the upper bar 210 and lower bar 208 of the rung 106 such that the end portion 312 is in contact with the back surface of the upper and lower bars 208 and 210 of the rung 106. The lower support bar 304 is positioned in front of the bars 208 and 210 of the rung and behind end portion 312 of the second support bar 304. The end 310 of the upper support beam 302 prevents the shelving unit 108 from rotating down towards the open end of the support frame 102. Further, the end 312 of the lower support bar 304 prevents the shelving unit 108 from rotating upwards towards the top of the support frame 102. Accordingly, the support member prevents the rotation of the shelving unit 108, thereby locking the shelving unit 108 in place between the support units 102 and 104. As one having ordinary skill will recognize, by providing the opposing L shaped portions 310 and 312, the connection of the shelving units 108 to the support units 102 and 104 produces a safe and sturdy shelving system.

In the present disclosure, the words "a" or "an" are to be taken to include both the singular and the plural. Conversely, any reference to plural items shall, where appropriate, include the singular.

It should be understood that various changes and modifications to the presently preferred embodiments disclosed herein will be apparent to those skilled in the art. Such changes and modifications can be made without departing from the spirit and scope of the present disclosure and without diminishing its intended advantages. It is therefore intended that such changes and modifications be covered by the appended claims.

What is claimed is:

1. A shelving system including:

a first support unit including a plurality of rungs;

a second support unit including a plurality of rungs; and at least one shelf unit including a first securing unit having a first upper support and a first lower support on a first side of the shelf unit and a second securing unit including a second upper support and a second lower support on an opposite side of the shelf unit , wherein, each first upper support and first lower support of the first securing unit and second upper support and second lower support of the second securing unit includes a first end and a second end with each first end of each upper support being positioned opposite a respective first end of the lower support and each second end of each upper support being positioned opposite a respective second end of the lower support, and each first end of each upper support in each of the first and second securing unit engages at least two of the same rungs as each first end of the lower support in each of the first and second securing unit.

2. The shelving system of claim 1 wherein the first end and second end of the first upper and first lower support are substantially L shaped, and the first end and second end of the second upper support and second lower support are substantially L shaped.

3. The shelving system of claim 2 wherein the L shaped ends of opposing first upper support and first lower support and second upper support and second lower support are substantially parallel.

4. The shelving system of claim 1 including a mesh unit substantially coplanar with the second support bar in the shelf unit.

5. The shelving system of claim 4 wherein the mesh unit is affixed to the shelf unit by cross units.

6. The shelving system of claim 5 wherein the cross units are affixed to the first lower support and second lower support.

* * * * *